US006641425B1

(12) United States Patent
Wu

(10) Patent No.: US 6,641,425 B1
(45) Date of Patent: Nov. 4, 2003

(54) ELECTRICAL CONNECTOR HAVING A LATCH MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/217,636

(22) Filed: Aug. 12, 2002

(51) Int. Cl.[7] ..... H01R 13/627
(52) U.S. Cl. ..... 439/352; 439/607
(58) Field of Search ..... 439/352, 353, 439/350, 351, 356, 357, 358, 607

(56) References Cited

U.S. PATENT DOCUMENTS 5,564,939 A * 10/1996 Maitani et al. ..... 439/352
5,634,809 A * 6/1997 Hirai ..... 439/352
5,951,316 A * 9/1999 Kawano et al. ..... 439/352
6,394,842 B1 * 5/2002 Sakurai et al. ..... 439/607

* cited by examiner

*Primary Examiner*—Hien Vu
(74) *Attorney, Agent, or Firm*—Wei Te Chung

(57) ABSTRACT

An electrical connector (1) includes a base (10) and a cover (20) assembled together. The base and cover each define a pair of channels (121, 221). A pull tab (80) has an operation portion (81) and a pair of arms (82) extending from the operation portion. The pair of arms are received in the channels with the operation portion located outside of the base and cover. Each arm has a latch releasing portion (83) at a free end thereof. A pair of metal springs (90) is assembled to inner sides of the arms. Each metal spring abuts against a rear portion of the base. After the pull tab is pulled rearwards to cause the metal springs deformed, the complementary connector is released, the metal spring resumes to an original position thereby push the pull tab to return back to an original position.

8 Claims, 10 Drawing Sheets

ELECTRICAL CONNECTOR HAVING A LATCH MECHANISM

CROSS-REFERENCE TO RELATED APPLICATIONS

The present invention is a continuation-in-part of the patent application entitled, "ELECTRICAL CONNECTOR HAVING A LATCH MECHANISM", with an known serial number and a filing date of Jul. 30, 2002, and assigned to the assignee of the present invention, and the content of which is incorporated herein by reference now.

BACKGROUND OF THE INVENTION

1. Field of the Invention

The present invention relates to an electrical connector, and particularly to an electrical connector having a pull tab and a pair of latch springs for engaging and releasing a mated complementary connector.

2. Description of Prior Art

U.S. Pat. No. 5,564,939, issued to Yukihiro Maitani et al, on Oct. 15, 1996, discloses a conventional electrical connector disclosed in the patent has a pair of latch springs 22 and 22A respectively attached on opposite sides of a housing 21 of the connector. An operating member 23 has a pair of latch releasing cams 23-4 located below angled portions 22-4 of the latch springs 22, 22A. When an operator pulls a pull tab 23-8 of the operating member 23 backwardly, the latch releasing cams 23-4 exert outward forces on the angled portions 22-4 and U-shaped claws 22-1 slip out to release a mated complementary connector. Because the operating member 23 and the latch springs 22, 22A are positioned outside of the housing 21, they are very easy to be damaged when a force is exerted thereon. When two or more such connectors are arranged side by side, a relatively large space is needed between every two connectors and this adversely affects the compact design of an electronic system including such connectors. Furthermore, when the pulling force acting on the operating member 23 is released, the latch springs 22, 22A exert a force to push the operating member 23 to its original position. However, the force is too little to pull the operating member 23 exactly to the original position. To overcome the above mentioned disadvantages, an electrical connector is needed that a pull tab of the connector which can be automatically return to its original position, and a better protection is provided to the latch springs to prevent them from damage by an external force.

SUMMARY OF THE INVENTION

It is an objective of the present invention to provide an electrical connector having a pull tab engaging with a pair of latch springs for latching and releasing a mated complementary connector, the pull tab with the latch springs can automatically resume to an original position after released the complementary connector.

In order to achieve the object above-mentioned, an electrical connector in accordance with the present invention includes a base defining a pair of elongated first channels on opposite sides thereof, a cover being assembled to the base and defining a pair of elongated second channels on opposite sides thereof corresponding to the first channels of the base. A pull tab has an operation portion and a pair of arms extending from a pair of ends of the operation portion. The pair of arms is respectively received in the first and second channels, and the operation portion locates outside the base and the cover. Each arm has a latch releasing portion at a free end thereof, a metal spring assembled to an inner side of the arm. Each metal spring abuts against a rear portion of the base. A pair of latch springs is cooperated with the pull tab for engaging with a complementary connector when said complementary connector is mated with the electrical connector. When the pull tab is pulled rearwards, the latch releasing portions push the latch springs for separating from the complementary connector and the metal springs are elastically deformed. When the pull tab is released, the metal springs resumes to an original position, thereby push the pull tab to return to an original position.

Other objects, advantages and novel features of the invention will become more apparent from the following detailed description when taken in conjunction with the accompanying drawings.

DETAILED DESCRIPTION OF THE INVENTION

Figure 1:
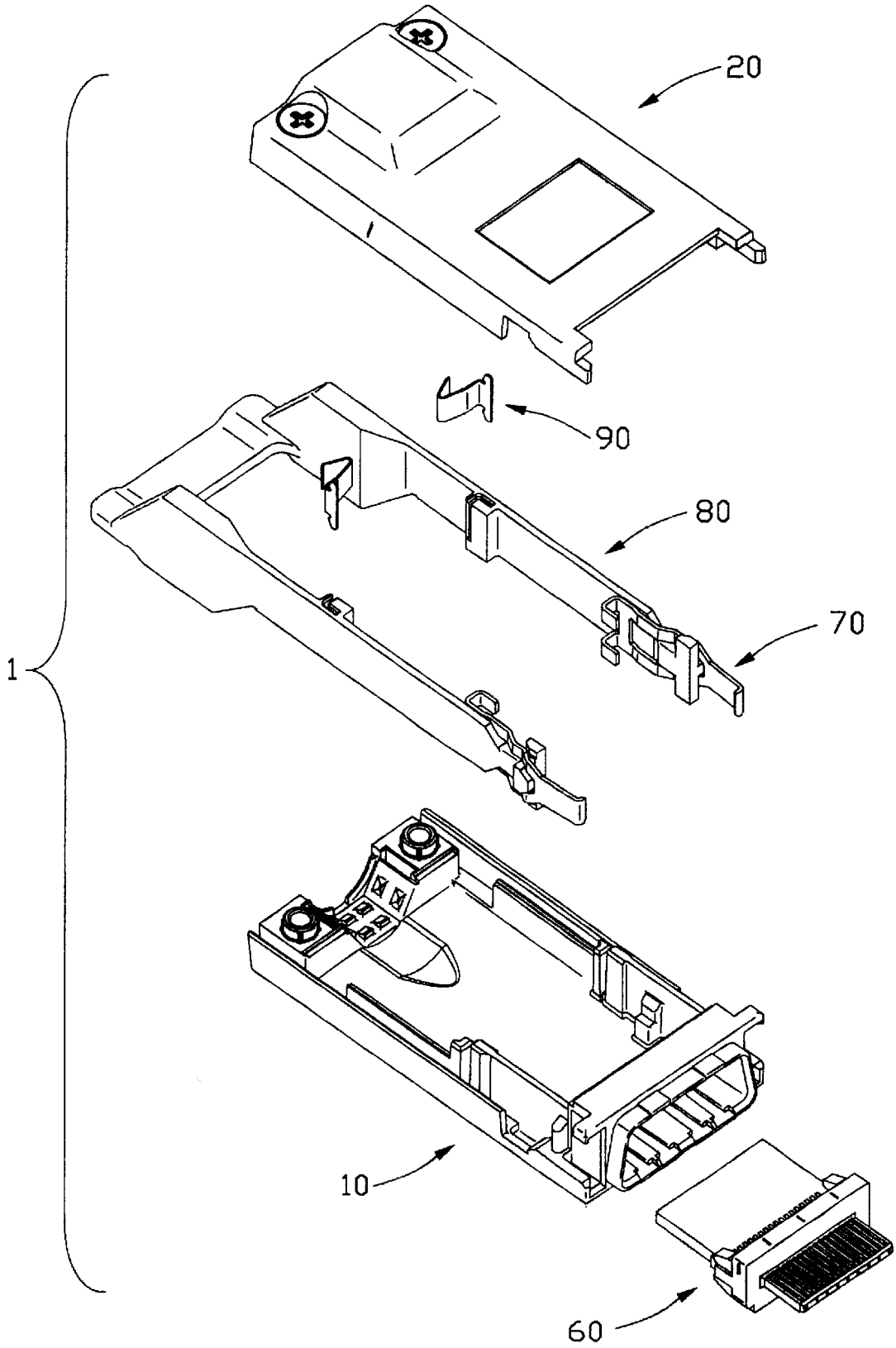
FIG. 1 is an exploded perspective view of an electrical connector in accordance with the present invention.

Referring to FIG. 1, an electrical connector 1 in accordance with the present invention comprises a base 10, a cover 20 for being assembled to the base 10, a pair of screws 30 for securing the cover 20 on the base 10, a connector subassembly 60, a spring latch 70, and a pull tab 80 and a pair of metal springs 90.

Figure 2:
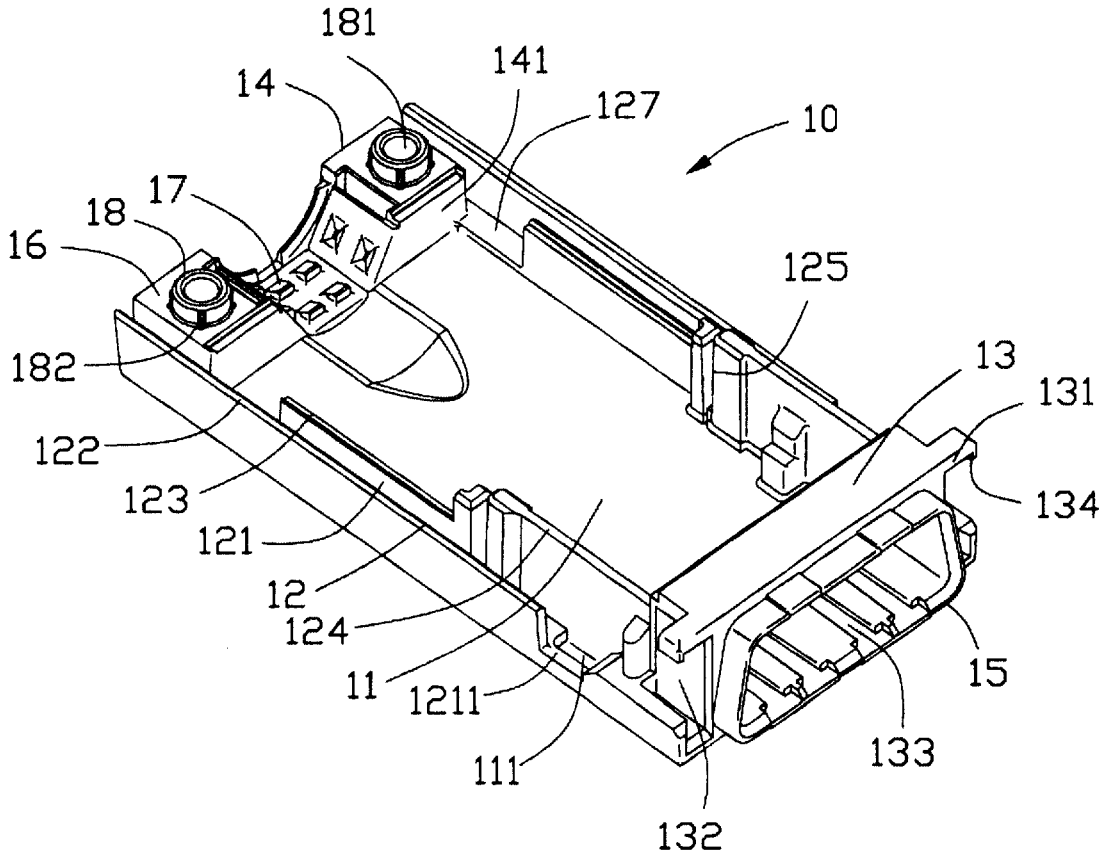
FIG. 2 is an enlarged perspective view of a base shown in FIG. 1.

The base 10 and the cover 20 are formed by die casting metallic material, for example, aluminum alloy. Referring to FIG. 2, the base 10 comprises a base plate 11 and a pair of sidewalls 12 upwardly extending from opposite lateral sides of the base plate 11. Each sidewall 12 defines an elongated channel 121 from a rear portion 14 toward a front end 15 of the base 10 and extending through a top engaging face 16 thereof. Each sidewall 12 is divided into an outer wall 122 and an inner wall 123 by the channel 121. The inner walls 123 each have a higher shoulder portion 124 adjacent to the front end 15 and define a cutout 127 adjacent to the rear portion 14. The shoulder portions 124 each define a vertical slit 125 at a rear end thereof. The outer walls 122 each define a cutout 1211 adjacent to the front end 15. The base plate 11 defines a pair of grooves 111 each being located between the shoulder portion 124 of a corresponding inner wall 123 and a corresponding cutout 1211. A mating frame 13 is formed at the front end 15 of the base 10. The mating frame 13 defines an opening 133 through the front end 15. A pair of engaging ears 131 is formed on opposite sides of a top of the mating frame 13 and extends laterally. Each engaging ear 131 has a protrusion 134 downwardly extending from a free end thereof. A pair of engaging spaces 132 is defined in opposite sides of the mating frame 13 and between the engaging ears 131 and the base plate 11. The base 10 has a first substantially semicircular opening 17 at the rear portion 14. A pair of posts 18 protrudes upwardly from the engaging face 16, located respectively at opposite sides of the first opening 17. Each post 18 defines a screw hole 181 therein and has four ribs 182 on a circumferential periphery thereof.

Figure 3:
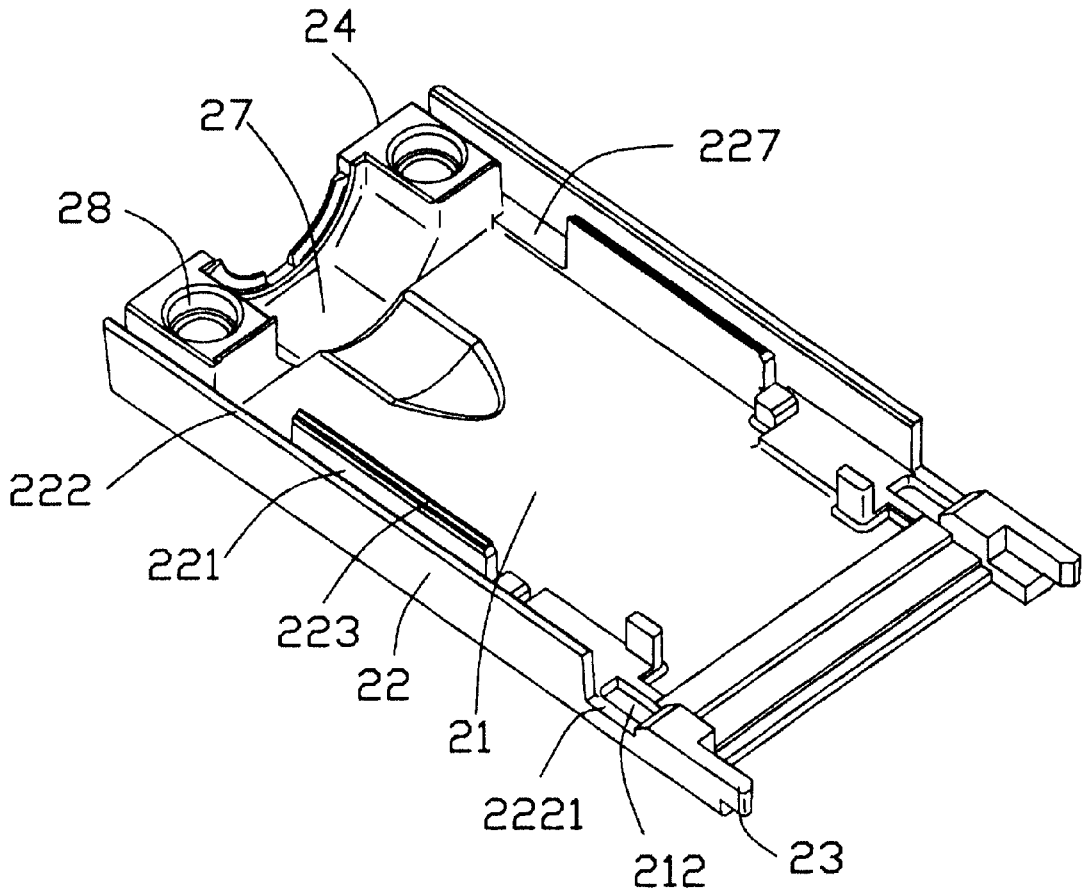
FIG. 3 is an enlarged perspective view of a cover shown in FIG. 1 from a bottom aspect.

Referring to FIG. 3, the cover 20 comprises a cover plate 21 and a pair of sidewalls 22 downwardly extending from opposite lateral sides of the cover plate 21. Each sidewall 22 defines an elongated channel 221 corresponding to the channel 121 of the base 10. Each sidewall 22 is divided into an outer wall 222 and an inner wall 223 by the channel 221. Each inner wall 223 defines a cutout 227 adjacent to a rear end 24 corresponding to the cutout 127 of the base 10. A pair of grooves 212, corresponding to the grooves 111 in the base 10, is defined in the cover plate 21 in inner sides of a pair of cutouts 2221 which is corresponding to the cutouts 1211 in the base 10. A pair of projections 23 extends forwardly from opposite sides of a front end of the cover plate 21. A semicircular second opening 27 is defined in a rear end 24 of the cover plate 21 corresponding to the first opening 17 of the base 10. A pair of holes 28 is defined in the rear portion 24, locating at opposite sides of the second opening 27. Each hole 28 has a diameter generally equal to an outer diameter of each of the posts 18.

Figure 4:
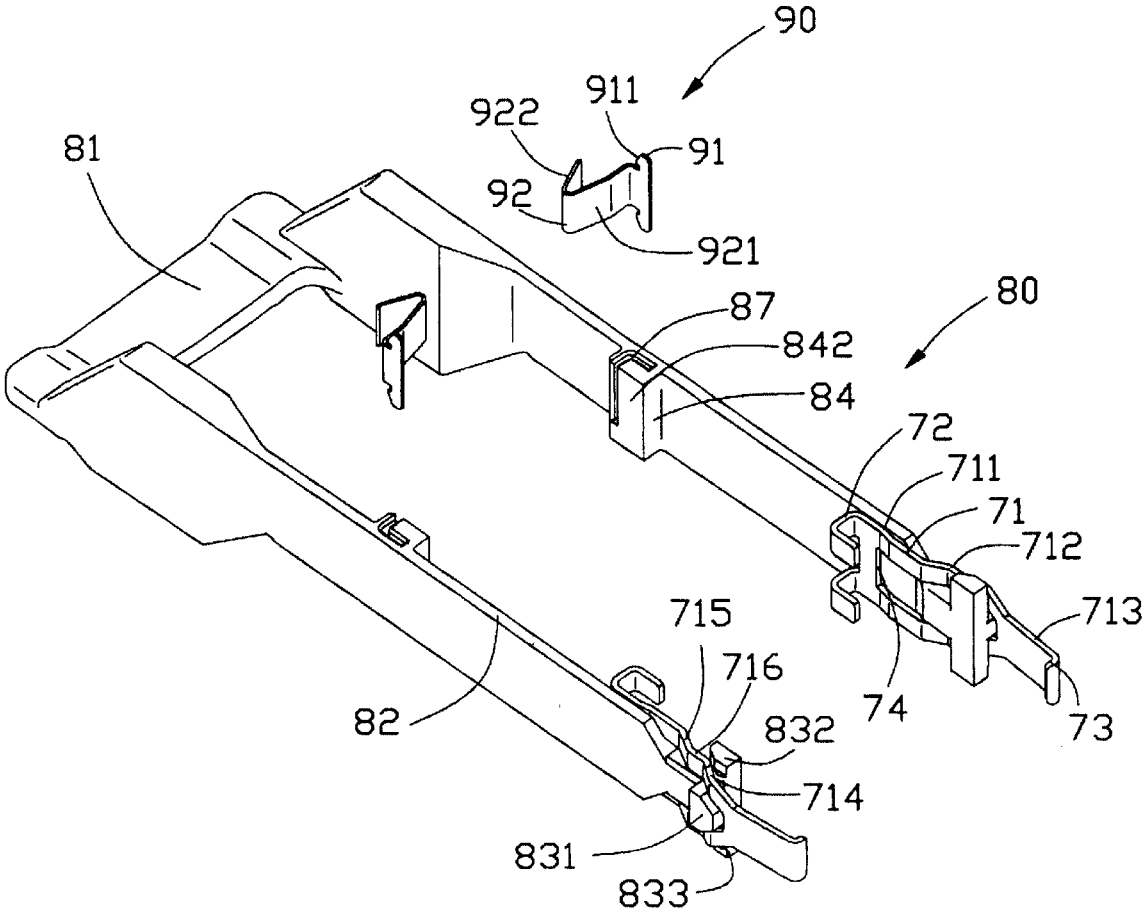
FIG. 4 is an enlarged perspective view of a pair of latch springs, a pull tab and a pair metal springs shown in FIG. 1.

Referring to FIG. 4, each of the latch springs 70 is formed by stamping a metal sheet and has a body portion 71, a U-shaped claw portion 72 formed at a rear end of the body portion 71, and an L-shaped claw portion 73 formed at a front end of the body portion 71. An elongated cutout 74 is defined in the body portion 71 in a front to rear direction. The body portion 71 comprises a rear portion 711, a middle portion 712, and a front portion 713 extending inwardly from the middle portion 712. The middle portion 712 comprises a front slope portion 714, a rear slope portion 715, and an intermediate portion 716 between the front and rear slope portions 714, 715.

The pull tab 80 comprises an operation portion 81, a pair of arms 82 extending forwardly from opposite sides of the operation portion 81, and a pair of latch releasing portions 83 formed at front ends of the arms 82, respectively. Each latch releasing portion 83 has upper and lower ends 832, 833, and a protrusion 831 protruding outwardly from an outside face thereof. Each arm 82 has a block 84 formed on inner side thereof. A pair of L-shaped slits 87 is defined in the blocks 84 from inner faces 842 of the blocks 84 to the arms 82. Each metal spring 90 comprises a retaining portion 91 and a U-shaped spring portion 92 extending from the retaining portion 91. The spring portion 92 has a first section 921 perpendicularly extending from the retaining portion 91 and a second section 922 extending from the first section 921 and bent toward the retaining portion 91. The retaining portion 91 has a pair of barbs 911 formed thereon.

Figure 5:
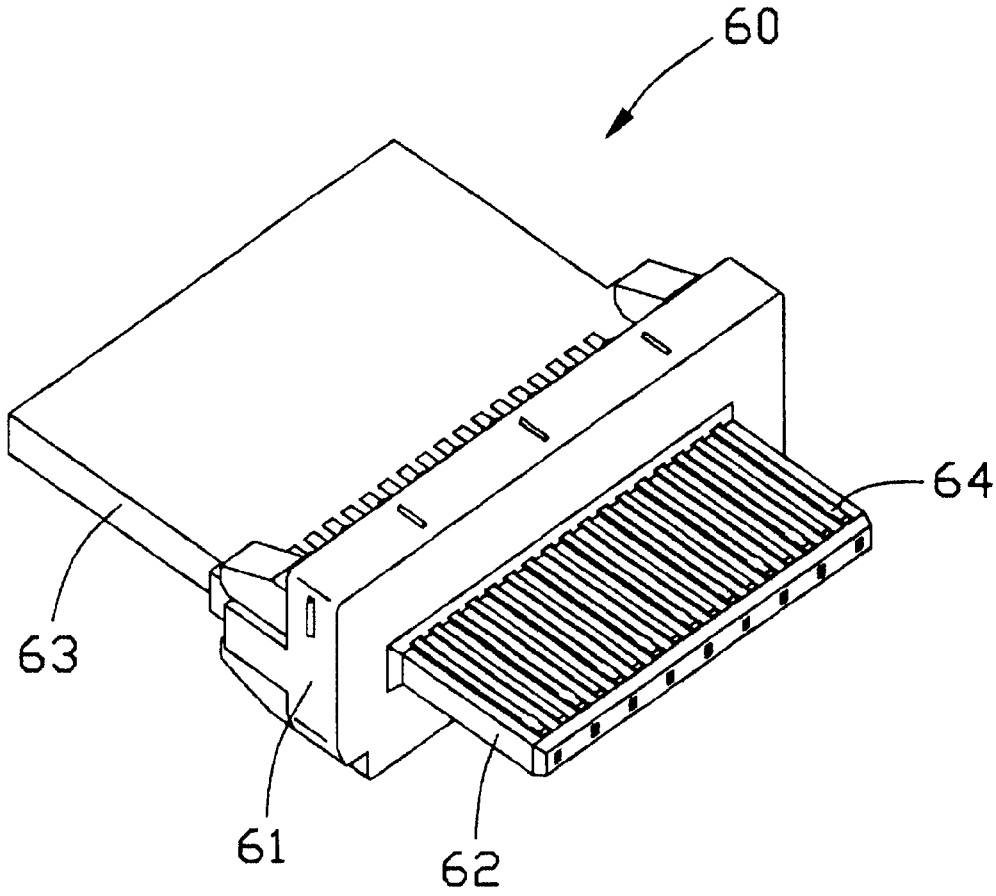
FIG. 5 is an enlarged perspective view of a connector subassembly shown in FIG. 1.
Figure 6:
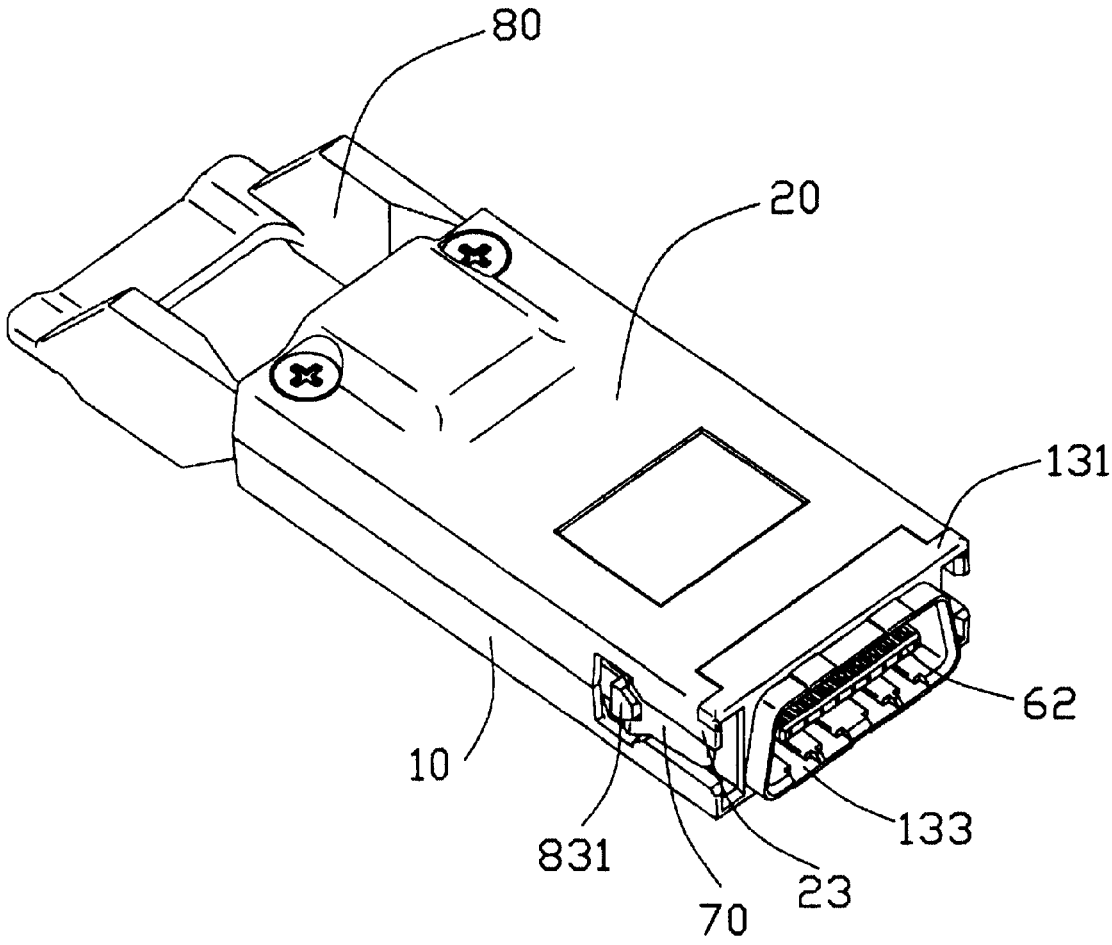
FIG. 6 is an assembled view of the electrical connector shown in FIG. 1.
Figure 7:
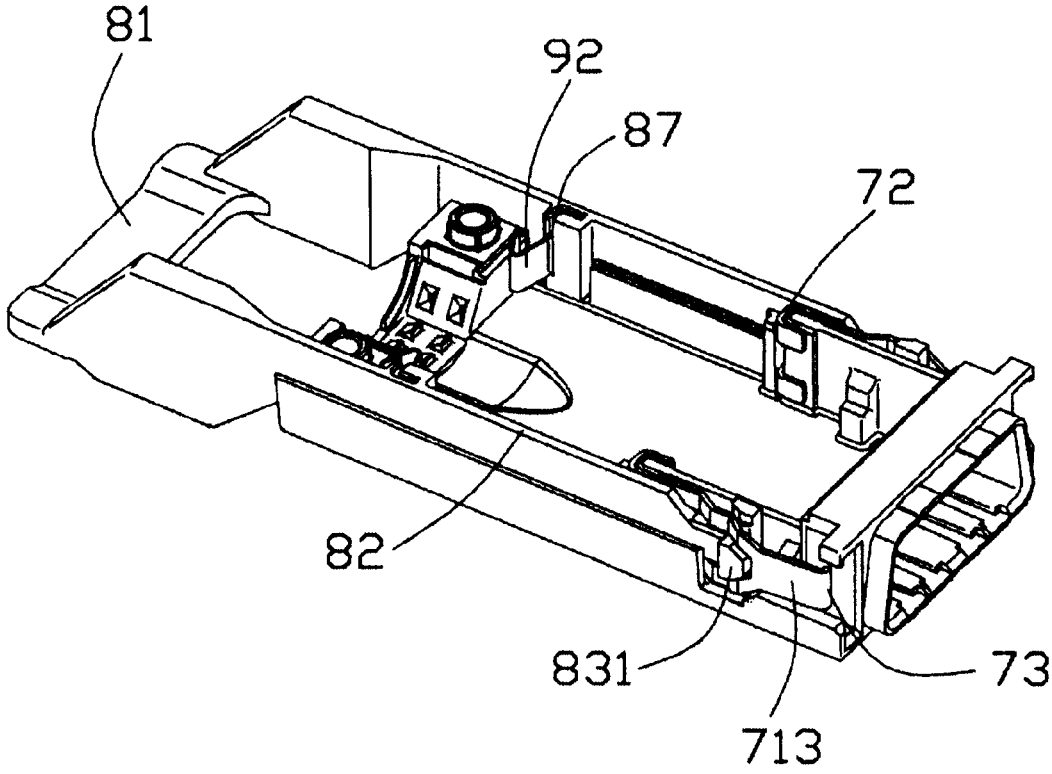
FIG. 7 is a view similar to FIG. 6, with the cover being unmoved.

Referring to FIG. 5, the connector subassembly 60 comprises an insulating housing 61, a tongue portion 62 extending forwardly from the housing 61, a printed circuit board (PCB) 63 assembled to the housing 61 at a rear side thereof. A plurality of contacts 64 is received in the tongue portion 62 and extends through the housing 61 to electrically connect the PCB 63.

Referring to FIGS. 6–9, in assembly, the connector subassembly 60 is assembled to the base 10 with the tongue portion 62 received into the opening 133. The PCB 63 is received in the base 10 between the two sidewalls 12. Two latch springs 70 are respectively assembled to the pull tab 80 by extending the protrusions 831 into the cutouts 74 from inner faces of the latch springs 70, whereby the latch releasing portions 83 engage with the inner faces of the latch springs 70, respectively. The latch releasing portions 83 are positioned at inner sides of the front portions 713. The metal springs 90 are assembled to the pull tab 70 with the retaining portions 91 received in the slits 87. Then, the latch springs 70 together with the pull tab 80 and the metal spring 90 are assembled to the base 10. The arms 82 are placed into the channels 121 with the operation portion 81 located outside of the rear portion 14 of the base 10. The blocks 84 are positioned in the cutout 127 and the second section 922 of the spring portions 92 abut against the rear portion 14 of the base 10. The U-shaped claw portions 72 are received into the slits 125 and engaged with the shoulder portions 124 to secure the latch springs 70 to the base 10. The L-shaped claw portions 73 extend into the engaging spaces 132. The lower tip ends 833 of the latch releasing portions 83 are placed in the grooves 111 with the protrusions 831 extending into the cutouts 1211. The cover 20 is assembled to the base 10 by placing the projections 23 beneath under the pair of engaging ears 131. Then a rear portion of the cover 20 is rotated downwardly about the pair of engaging ears 131 until a bottom face of the cover 20 intimately abuts the engaging face 16 of the base 10. Upper portions of the arms 82 are received in the channels 221, the upper tip ends 832 of the latch releasing portions 83 are received into the grooves 212 of the cover 20, and upper portions of the blocks 84 positioned in the cutouts 227. The posts 18 are received into the holes 28 with the four ribs 182 engaging with inner surfaces of the holes 28. The first and second openings 17 and 27 together form a cable receiving opening for extension of a cable (not shown) therethrough. Finally, the screws 30 are screwed into the screw holes 181 to securely fasten the cover 20 and the base 10 together, whereby the electrical connector 1 in accordance with the present invention is obtained.

An operation of the electrical connector 1 in introduced below.

Figure 8:
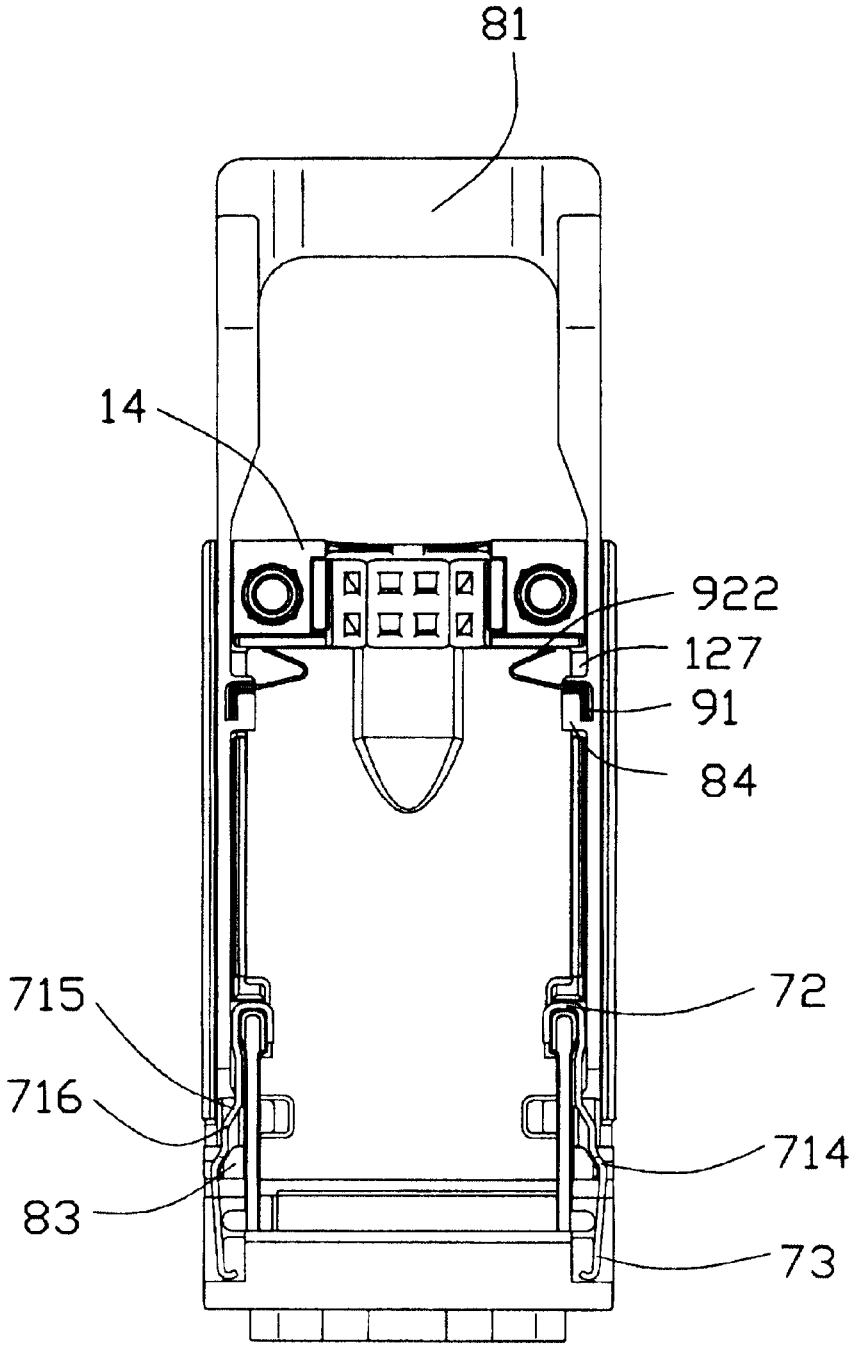
FIG. 8 is a top view of FIG. 7, in which the latch springs are in a latching position.
Figure 9:
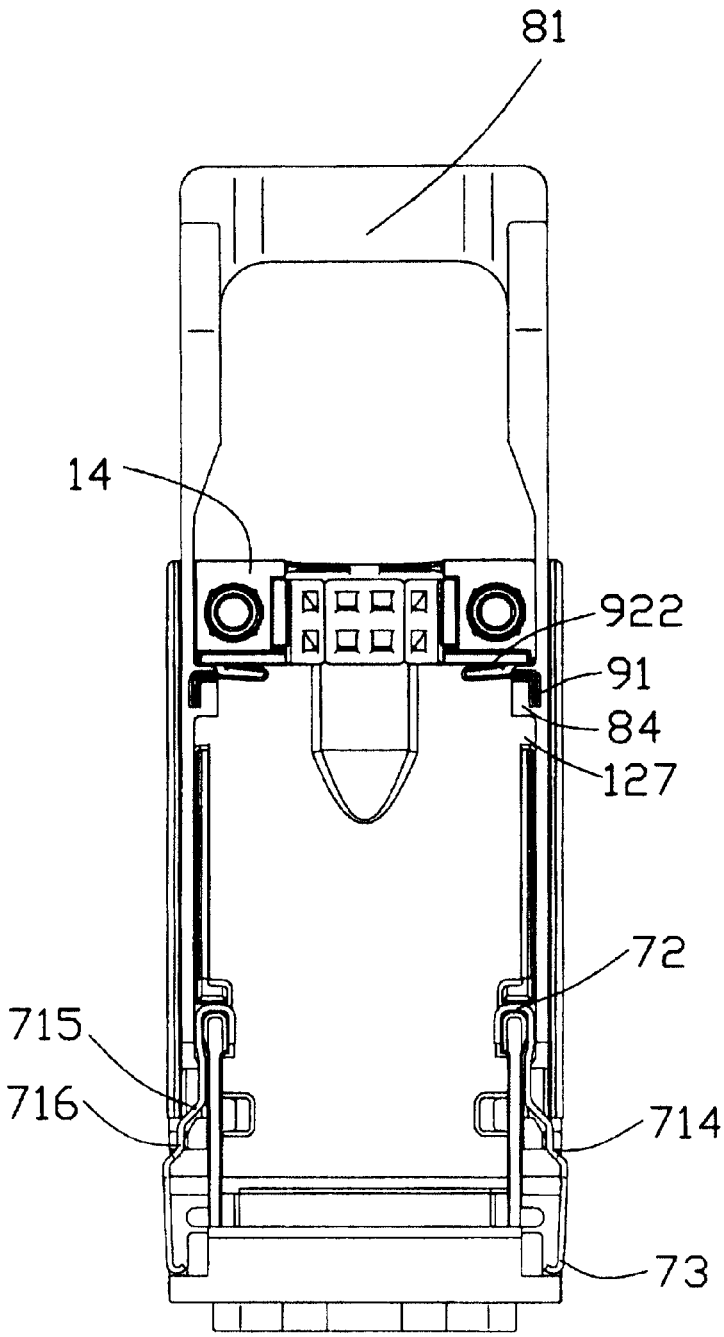
FIG. 9 is a view similar to FIG. 8, showing a pair of metal springs in a deformed shape.

Referring to FIGS. 8 and 9, when the complementary connector is mated with the electrical connector 1 of the present invention, the L-shaped claw portions 73 clamp corresponding engaging portions of the complementary connector. The electrical connector 1 is unmated with the complementary connector by the following operation. An operator grips the operation portion 81 of the pull tab 80 and pulls it rearwards, whereby the pull tab 80 is moved rearwards. The upper and lower tip ends 832, 833 slide in the grooves 111, 212 and the protrusions 831 slide in the cutouts 74. When the latch releasing portions 83 come into contact with the front slope portions 714, they exert an outward force on inner faces of the front slope portions 714. The latch spring 70 is elastically deformed and the front portion 713 is pushed out. Thus, the L-shaped claw portions 73 are driven to move out of the engaging portions of the complementary connector. When the latch releasing portions 83 slide on the intermediate portions 716, the intermediate portions 716 have an inward force exerted on the latch releasing portions 83. In the same time, the metal springs 90 are elastically deformed to a deflective position and transmit a pull force to the connector and the whole connector is pulled out of the complementary connector.

When the pulling force acting on the pull tab 80 is released, the metal spring 90 resumes to its original position, thereby push the pull tab 80 to return back to original position. At the same time, the latch releasing portions 83 return to contact the front slope portions 716, the latch springs 70 resumes to its original position by a spring force itself.

Figure 10:
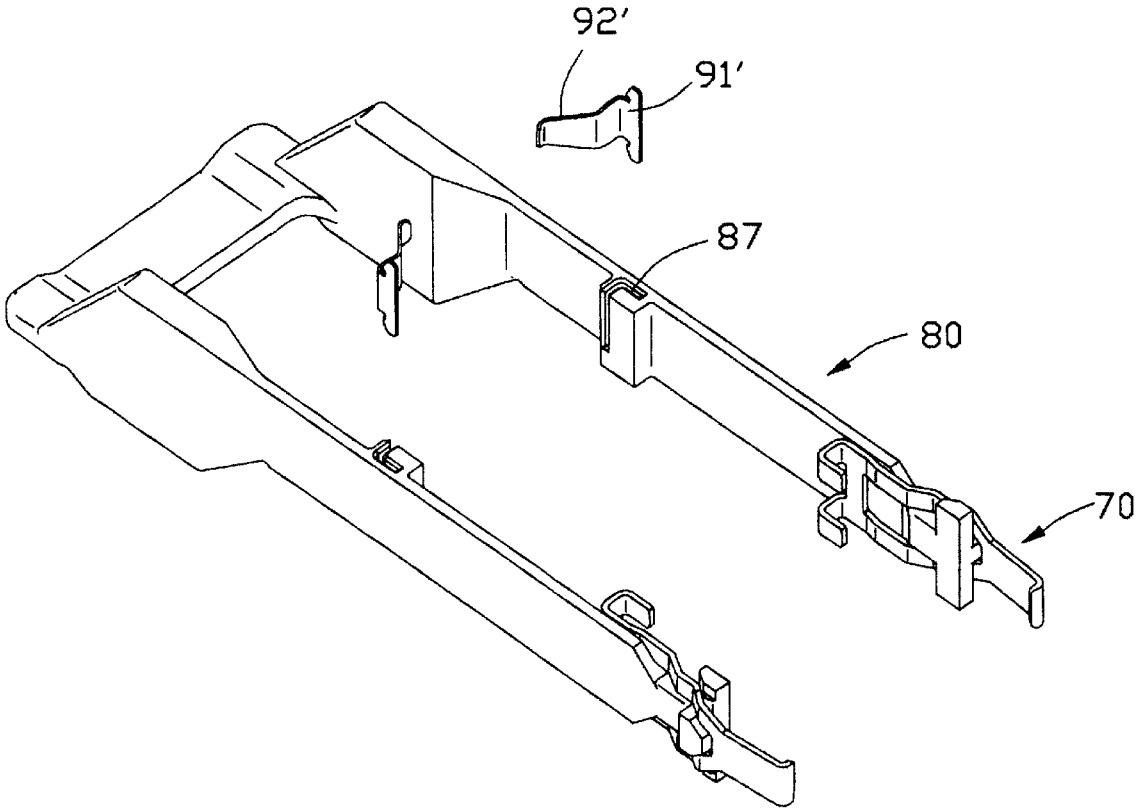
FIG. 10 is an enlarged perspective view of a pair of metal springs and a pull tab of an electrical connector of a second embodiment.

FIG. 10 shows a second embodiment of a metal spring 90' of the present invention. The metal spring 90' comprising a retaining portion 91' and a spring portion 92' extending obliquely from the retaining portion 91'. When the metal spring 90' is assembled into the slit 87, the spring portion 92' abuts against the rear portion 14 of the base. The metal spring 90' has a same function as the metal spring 90.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the biasing spring 90 may be integrally formed with the pull tab 70, or even with the same material.

What is claimed is:

1. An electrical connector assembly for mating with a complementary connector, comprising:

a base having a mating frame formed on a front portion thereof;

a connector subassembly assembled into the mating frame and having a plurality of terminals received therein;

a cover assembled to the base;

a pull tab having a latch releasing portion, and having biasing means assembled thereto;

a pair of latch springs cooperating with the pull tab for engaging hooks of the complementary connector; and wherein when the pull tab is pulled in a first direction, the latch releasing portions pulling the latch springs for separating the hooks of the complementary connector, and the biasing means abutting against the base or cover and being elastically deformed, when the pull tab is released, the biasing means resuming to an original position, thereby pushing the pull tab to return back to original position; wherein the pull tab has an operation portion and a pair of arms extending from a pair of ends of the operation portion, the latch releasing portion is formed at free ends of the arms; wherein the base defines a pair of elongated first channels on opposite sides thereof, the pair of arms are respectively received in the first channels and the operation portion locates outside the base and the cover; wherein the biasing means are a pair of metal springs assembled to inner sides of the arms of the pull tab; wherein each metal spring comprises a retaining portion assembled to the arm and a spring portion extending from the retaining portion; wherein each arm of the pull tab has a block formed on inner side thereof, each block defines a slit, the retaining portions of the metal springs are received into the slits; wherein each latch spring has a first claw portion engaging with the base, a second claw portion adapted for engaging with the hook of the complementary connector, and a sloping portion between the first and second claw portions and engaging with a corresponding latch releasing portion of the pull tab.

2. The electrical connector as described in claim 1, wherein each spring portion of the metal spring has a first section extending from the retaining portion along a direction perpendicular to the retaining portion and a second section extending from the first section and bent toward the retaining portion.

3. The electrical connector as described in claim 1, wherein each spring portion of the metal spring extends obliquely from the retaining portion.

4. The electrical connector as described in claim 1, wherein each retaining portion of the metal spring has a pair of barbs engaging with inner walls of the slit.

5. The electrical connector as described in claim 1, wherein the cover defines a pair of elongated second channels on opposite sides thereof corresponding to the first channels of the base, upper portions of the arms of the pull tab are received in the second channels.

6. The electrical connector as described in claim 1, wherein when the latch releasing portions push the sloping portions, the sloping portions deflect an outwardly to motivate the second claws to move outwardly accordingly whereby a latch of the second claws with the hooks of the complementary connector is released.

7. The electrical connector as described in claim 6, wherein the latch springs each has an intermediate portion on rear side of the sloping portion, after the latch releasing portions push the sloping portions to release the second claws from the hooks of complementary connector, the latch releasing portions contact with inner faces of the intermediate the portions, the intermediate portions have an inward force exerted on the latch releasing portions.

8. An electrical connector assembly for mating with a complementary connector, comprising:

a base having a mating frame formed on a front portion thereof;

a connector subassembly assembled into the mating frame and having a plurality of terminals received therein;

a cover assembled to the base;

a pull tab having a latch releasing portion;

a pair of latch springs cooperating with the pull tab for engaging with hooks of the complementary connector, each latch spring having a first claw portion engaging with the base, a second claw portion adapted for engaging with the hooks of the complementary connector, a sloping portion between the first and second claw portions, and an intermediate portion at rear side of the sloping portion, after the latch releasing portions push the sloping portions to release the second claws from the hooks of the complementary connector, the latch releasing portions contact with inner faces of the intermediate the portions, the intermediate portions have an inward force exerted on the latch releasing portions; wherein the pull tab having an operation portion and a pair of arms extending from a pair of ends of the operation portion, the latch releasing portion formed at free ends of the arms; wherein the base defines a pair of elongated channels on opposite sides thereof, the pair of arms respectively received in the channels and the operation portion located outside the base and the cover; wherein each arm has a metal spring comprising a retaining portion and a spring portion, said metal spring assembled to an inner side thereof, when the pull tab is pulled rearwards, the metal springs are elastically deformed, when the pull tab is released, the metal springs resume to original position, thereby push the pull tab to return back to original position; wherein each arm of the pull tab has a block formed on inner side thereof, each block defines a slit, the retaining portions of the metal springs are received into the slits.

* * * * *